US006923028B2

(12) United States Patent
Caldwell et al.

(10) Patent No.: US 6,923,028 B2
(45) Date of Patent: Aug. 2, 2005

(54) LOCKING SYSTEM FOR A DOOR

(76) Inventors: William J. Caldwell, 630 Sylvandale Dr., Oregon, OH (US) 43616; William D. Caldwell, 5650 Pickle Rd., Oregon, OH (US) 43618

( * ) Notice: Subject to any disclaimer, the term of this patent is extended or adjusted under 35 U.S.C. 154(b) by 0 days.

(21) Appl. No.: 10/687,527

(22) Filed: Oct. 16, 2003

(65) Prior Publication Data

US 2005/0081581 A1 Apr. 21, 2005

(51) Int. Cl.[7] ..... E05B 65/06; E05B 67/38

(52) U.S. Cl. ..... 70/56; 70/101; 70/129; 70/203; 70/212; 292/148; 292/150; 292/DIG. 32

(58) Field of Search ..... 70/2–13, DIG. 43, 70/DIG. 56, 54–56, 101, 129, 203, 210, 212; 292/148, 150, DIG. 32, 104, 205, 207, 208, 211, 283, 284, 286

(56) References Cited

U.S. PATENT DOCUMENTS

| | | | | | |
|---|---|---|---|---|---|
| 168,566 | A | * | 10/1875 | Hilton | 70/54 |
| 279,334 | A | * | 6/1883 | Clark | 292/36 |
| 1,364,757 | A | * | 1/1921 | Herrman | 292/150 |
| 1,456,611 | A | * | 5/1923 | Fritts | 292/189 |
| 1,658,762 | A | * | 2/1928 | Dickerson | 292/5 |
| 2,240,162 | A | * | 4/1941 | Nemec | 292/148 |
| 2,729,089 | A | * | 1/1956 | Pelcin | 70/151 R |
| 3,333,878 | A | * | 8/1967 | Pelcin | 292/37 |
| 3,334,933 | A | * | 8/1967 | Ehlers | 292/148 |
| 3,606,423 | A | * | 9/1971 | McCarthy | 292/148 |
| 3,806,176 | A | * | 4/1974 | Massie | 292/150 |
| 3,833,104 | A | * | 9/1974 | Blum | 194/350 |
| 3,933,382 | A | * | 1/1976 | Counts et al. | 292/144 |
| 4,109,949 | A | * | 8/1978 | Smith | 292/189 |
| 4,113,291 | A | * | 9/1978 | Cameron | 292/40 |
| 4,161,870 | A | * | 7/1979 | Barnes | 70/278.7 |
| 4,367,454 | A | * | 1/1983 | Modica | 340/426.34 |
| 4,491,354 | A | * | 1/1985 | Williams | 292/148 |
| 4,669,767 | A | * | 6/1987 | Leto | 292/259 R |
| 4,768,816 | A | * | 9/1988 | Bakula | 292/218 |
| 4,823,570 | A | * | 4/1989 | Jurek | 70/129 |
| 4,883,294 | A | * | 11/1989 | Goodspeed | 292/148 |
| 6,283,514 | B1 | * | 9/2001 | Letzel | 292/142 |
| 6,351,975 | B1 | * | 3/2002 | Valdes | 70/56 |

* cited by examiner

*Primary Examiner*—Lloyd A. Gall
(74) *Attorney, Agent, or Firm*—Emch, Schaffer, Schaub & Porcello, Co., L.P.A.

(57) ABSTRACT

A security locking system for trailers that features an interior locking bar that is controlled from the outside. The locking bar is traversed in a linear motion parallel to the door by a toggle mechanism. The bar is guided into the locking mechanism by two guides mounted to the inside of the trailer door. The toggle mechanism is turned using a common trailer latch that also locks by use of a key. Alternatively the latch could be modified to lock or unlock by using a remote activator. Once the latch is turned all the way (90 degrees) it will raise the locking bar into the upper secure bracket. The lower part of the locking bar will be lowered into the lock housing which is hidden just under the trailer floor, it will then be in position in the locking mechanism for the key pin to be inserted and then locked. The locking mechanism can also be modified to be controlled using a remote activator.

4 Claims, 5 Drawing Sheets

LOCKING SYSTEM FOR A DOOR

BACKGROUND OF THE INVENTION

The use of locks on the outside of trailer doors is known and typical. Regardless of the type of trailer from the smallest to the large tractor trailers, the method of securing the trailer is basically the same and needs to be improved. The disadvantage of the outside-style lock is that it is easy for thieves to break by cutting the lock or lock hasps. To limit access to a trailer's contents, owners of trailers will commonly back up heavy equipment against the trailer door when they leave the trailer. Tractor trailers occasionally will be backed up to a wall when left overnight. Owners of trailers try the methods described above because of the lack of effective security systems.

The present invention relates to a trailer security system that features an interior locking bar operated from the outside of the trailer. The locking mechanism is hidden underneath the trailer and is virtually impossible to remove with ordinary tools that thieves may have in their possession.

SUMMARY OF THE INVENTION

It is desirable to be able to increase trailer security by providing owners with the option of a more secure device to lock the door of the trailer. The present invention provides a better and more secure, simple, convenient and inexpensive device for locking the door of a trailer.

The present invention provides a locking bar inside of the trailer that is guided and secured by two guides which are mounted in a horizontal orientation using bolts to the interior of the trailer door. The locking bar may be raised and lowered into the desired position by means of a toggle mechanism. The toggle mechanism is a purchased component that actuates the locking bars by manual rotation. The toggle mechanism rotates while traversing the locking bars in a linear motion. The toggle mechanism is turned using a common trailer latch that also locks (secondary) by use of a key. When the latch is turned completely (90 degrees), the upper part of the locking bar is traversed into position at the top of the trailer above the door and the lower part of the bar will be lowered into the lock housing under the trailer floor. It is now in position to be locked. To lock, a hardened key pin is inserted into the lock housing and through the pin access opening of the locking bar and into the pad lock. The key pin is designed with a larger diameter at the end and in the locked position the hasp of the lock will lock down preventing the large diameter end of the key pin from being removed without unlocking the pad lock. Alternatively, the trailer latch and the locking mechanism in the lock housing can be modified to lock or unlock by means of a remote. The use of a remote is particularly useful where there is a source of power, such as a battery, available on the trailer or a truck that is used to pull the trailer.

To open, insert key in the key entry and pull the hardened key pin out. Then, you may raise the locking bar above the trailer floor by turning the trailer latch to the open position which is the opposite direction from which the bar was lowered.

Other objects and advantages of the present invention will become apparent to those skilled in the art upon a review of the following detailed description of the preferred embodiments and the accompanying drawings.

DETAILED DESCRIPTION OF THE PREFERRED EMBODIMENTS

Figure 1:
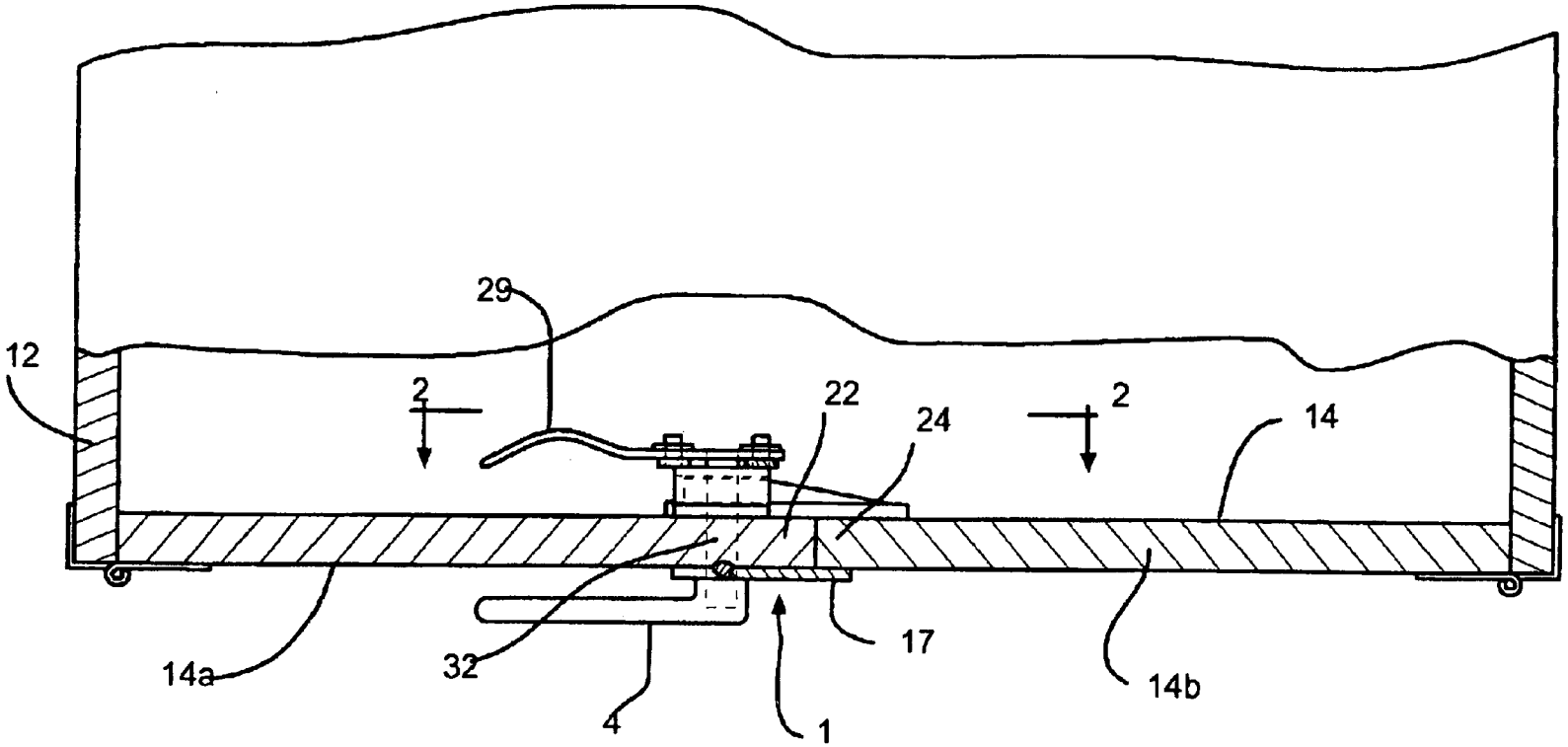
FIG. 1 is a cross sectional view taken along line 1—1 in FIG. 2 of the security system with the toggle mechanism method of operation.

As seen in FIGS. 1–5 the invention is a trailer locking system 1 having a locking bar 2 which is secured and guided by two guides 3 which are installed in a horizontal orientation using bolts to the inside of the trailer door 14. The trailer door 14 has a first section 14*a* and a second section 14*b* that are pivotally mounted to one end of a trailer 12. The locking system 1 is positioned on the first section 14*a* of the trailer door 14. The first section 14*a* has a flange 17 that extends from the edge 22 of the first section 14*a* and is disposed to overlap the edge 24 of the second section 14*b*. The flange 17 is positioned so that it overlaps the second section 14*b* when the door 14 is in the closed position as shown in FIG. 1. With this arrangement, if the first section 14*a* is in a locked position, the flange 17 will overlap the second section 14*b* and prevent the second section from being opened.

Figure 2:
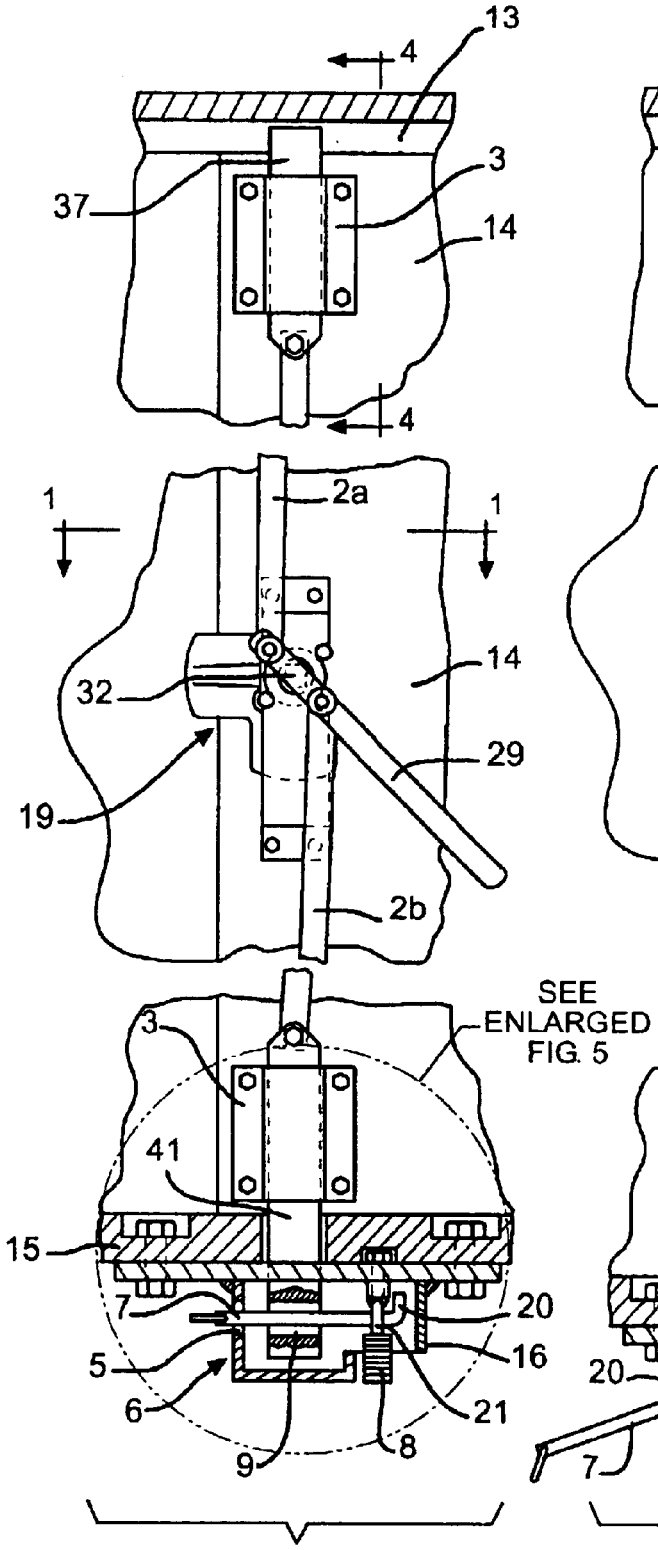
FIG. 2 is a cross sectional elevation view taken along line 2—2 in FIG. 1 of the security system in the locked position as seen from inside the trailer.
Figure 3:
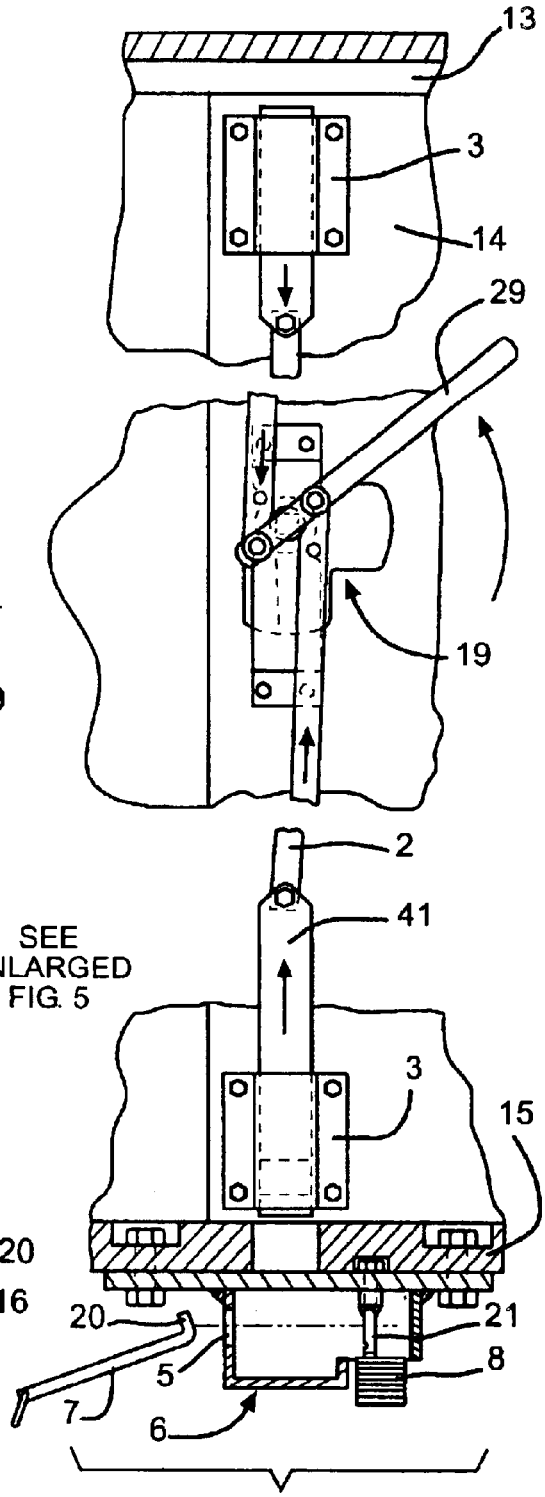
FIG. 3 is a cross sectional elevation view of the security system of FIG. 1 in the unlocked position as seen from the inside of the trailer.
Figure 4:
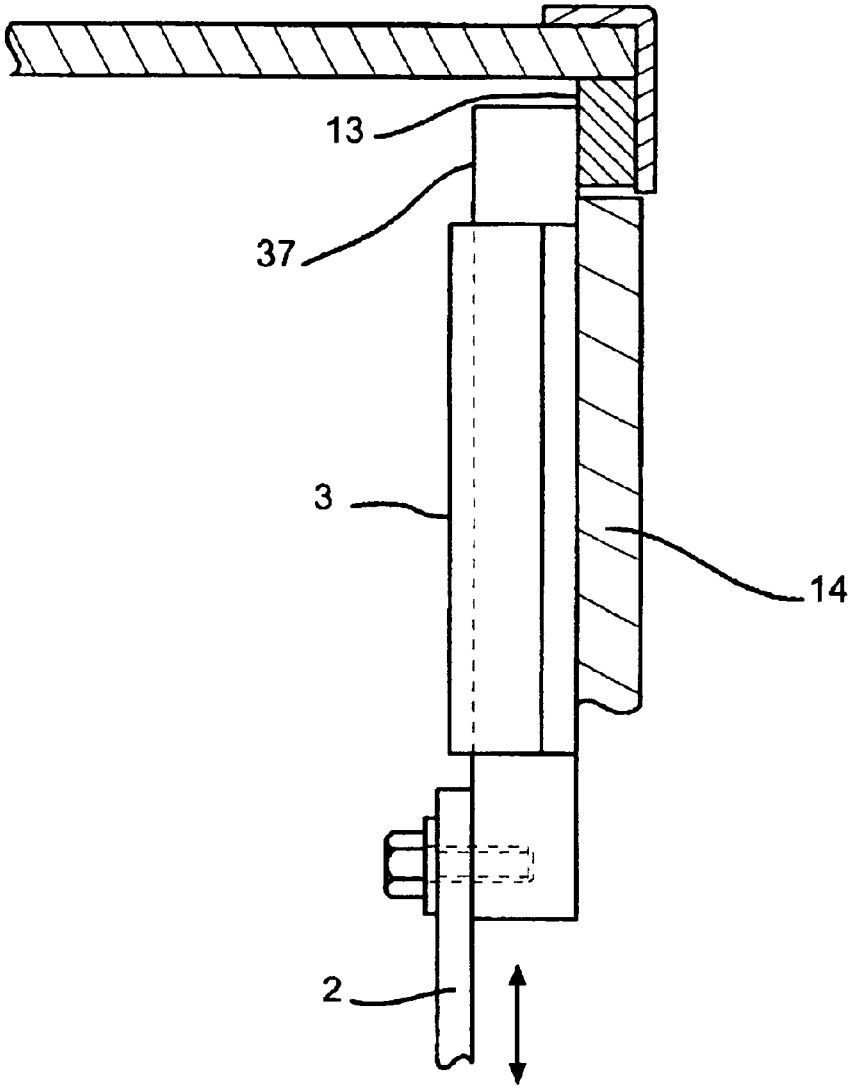
FIG. 4 is a partial cross sectional elevation view taken along line 4—4 in FIG. 2 of the security system.

The locking bar 2 has a first end 2*a* and a second end 2*b* that are connected to the toggle mechanism 19. The first and second ends of the locking bar are pivotally connected to a link bar 29 as shown in FIGS. 2 and 3. The link bar is secured to a shaft 32 that extends through the first section 14*a* of the door 14. A latch 4 is positioned on the end of the shaft 32 that extends from the outside of the first section 14*a* of the door 14.

The locking bar 2 is traversed in a linear motion parallel to the trailer door 14 by means of a toggle mechanism 19. The toggle mechanism 19 is turned using the link bar 29 or the trailer latch 4. When the trailer latch 4 is turned completely, usually approximately 90 degrees, it will raise first end 2*a* of the locking bar 2 upward to engage a portion 13 of the trailer located above the door 14. Then, the second end 2*b* of the locking bar 2 will move simultaneously downward into the lock housing 6 which is concealed just under the trailer floor 15. The two guides 3 will align the locking bar 2 in position to be locked as shown in FIG. 2. When the latch 4 or link bar 29 is turned in the opposite direction, as shown in FIG. 3, the locking bar 2 will be moved from the lock housing 6 and from engagement with the portion 13 and the trailer door 14 can be opened.

To enhance the effectiveness of the locking system 1, a securing member 37 can be pivotally attached to the end of first end 2*a* of locking bar 2 and a locking member 41 can be pivotally attached to the end of the second end 2*b* of locking bar 2. The securing member 37 and locking member 41 are larger in size than the locking bar 2 and provide more strength to resist a forced entry into the trailer. Usually the securing member 37 and locking member 41 are positioned so that they are slideably positioned in the guides 3 on the door 14. The locking member 41 has a pin access opening 9 that extends through the locking member.

Once the locking bar 2 is lowered into the lock housing 6, which is secured with bolts underneath the trailer floor 15 and hidden from view, the pin access opening will be positioned in the lock housing 6. A stop can be positioned on the locking bar 2 to limit the movement of the locking bar so that the pin access opening is in alignment with opening 5 in the lock housing 6. A hardened key pin 7 can then be inserted through the opening 5 in the lock housing 6, the locking bar's pin access opening 9 into the locking mechanism and the lock 8 can be closed.

Figure 5:
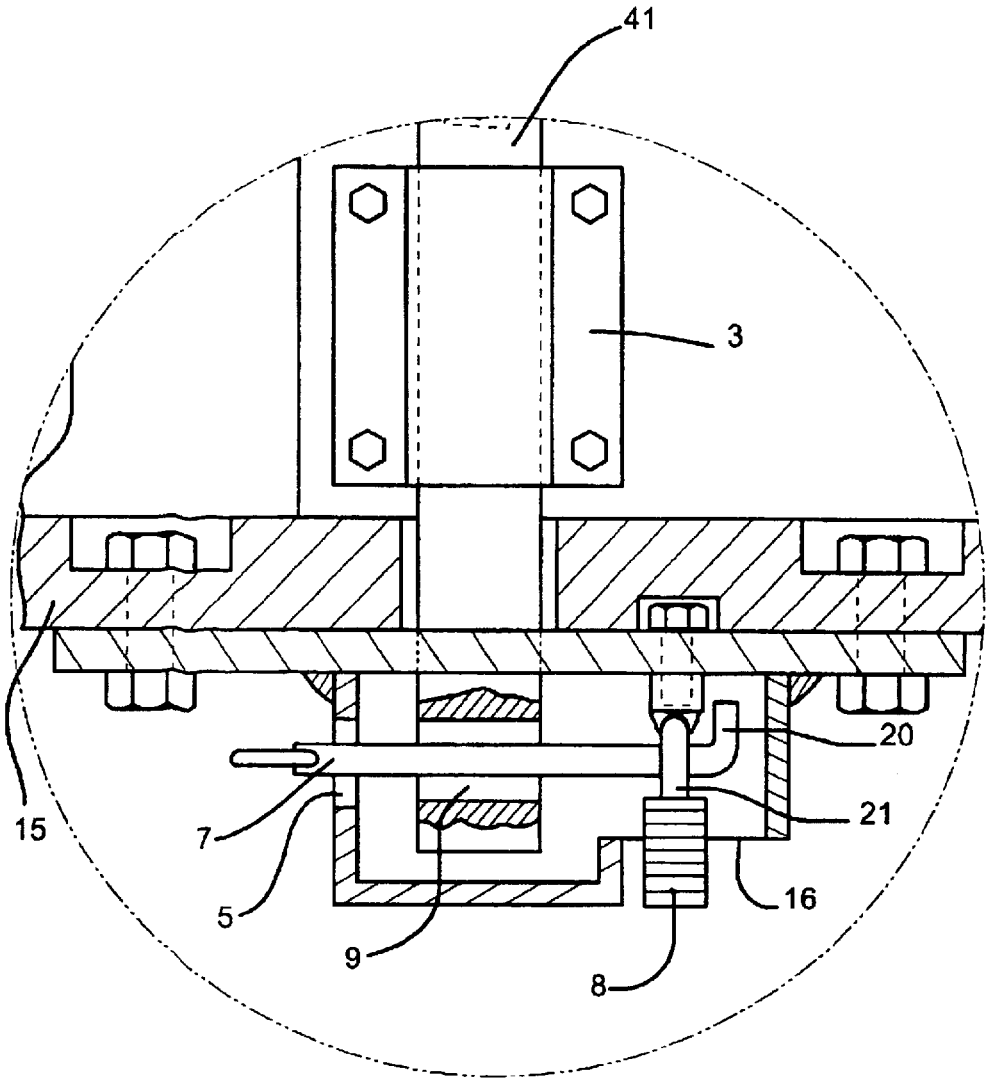
FIG. 5 is an enlarged cross section view of the locking mechanism shown in FIG. 2.

As seen in FIGS. 2, 3 and 5, there is a more in-depth view of the lock housing 6. The lock housing 6 is mounted with bolts underneath the trailer floor 15 hidden from view. With the locking bar 2 now in position in the lock housing 6, the pin access opening 9 will be aligned in position for the hardened key pin 7 to be inserted into the pin access opening 9 of the locking bar 2 and then through the hasp 21 of the open the pad lock 8. The hasp 21 of the pad lock 8 is welded to a bolt that is secured to the inside of the lock housing 6.

The key pin 7 has a larger diameter section 20 on the end of the key pin that is inserted into the lock housing 6. The larger diameter section 20 has a shape that allows the larger diameter section to pass through the hasp 21 of the pad lock 8 when the pad lock is in the open position. When the hasp 21 of the pad lock 8 is in the closed position, the larger diameter section 20 cannot pass through the hasp. Accordingly, the key pin 7 can be inserted into the pin access opening 9 and through the open hasp 21 of the pad lock 8. Once the hasp 21 of the padlock 8 is closed, the larger diameter section 20 prevents the key pin 7 from being removed from the pad lock and the pin access opening 9 in the locking bar 2 and secures the locking bar 2 in the locked position.

To open the locking system 1, insert the key in pad lock 8 at the key entry 16, open the pad lock and pull the key pin 7 from the hasp 21 and pin access opening 9. Once the key pin has been removed, the locking bar 2 can be moved to the position shown in FIG. 3 by rotation of the trailer latch 4 or link bar 29 and the trailer door 14 can be opened.

Figure 6:
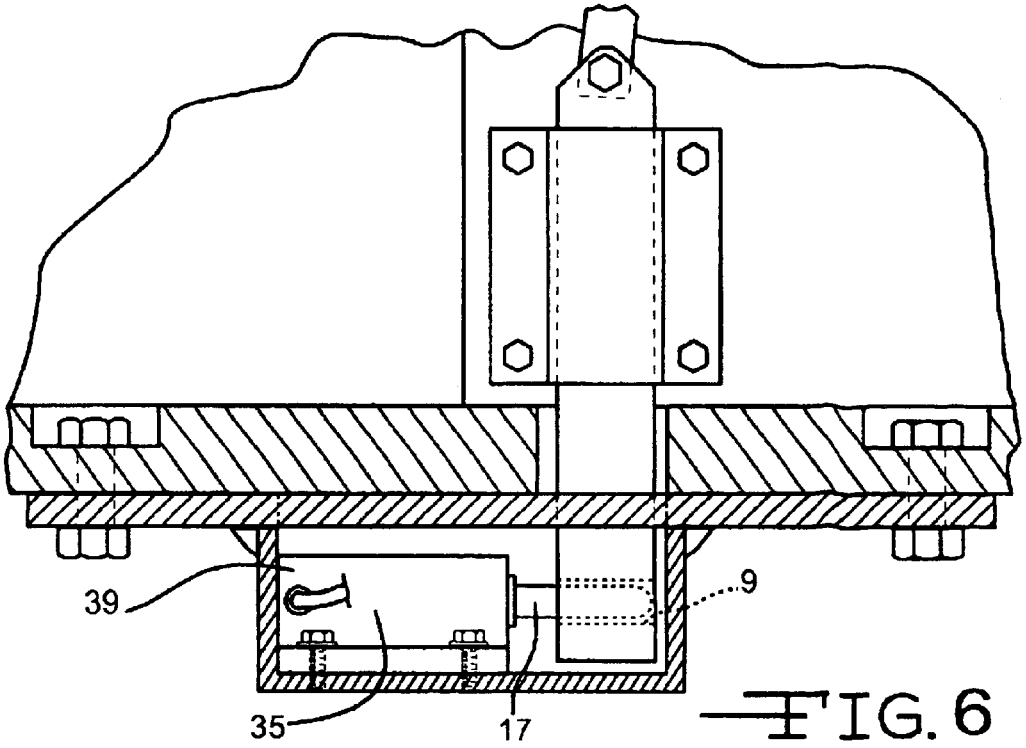
FIG. 6 is a cross sectional view of another locking mechanism in the locked position.
Figure 7:
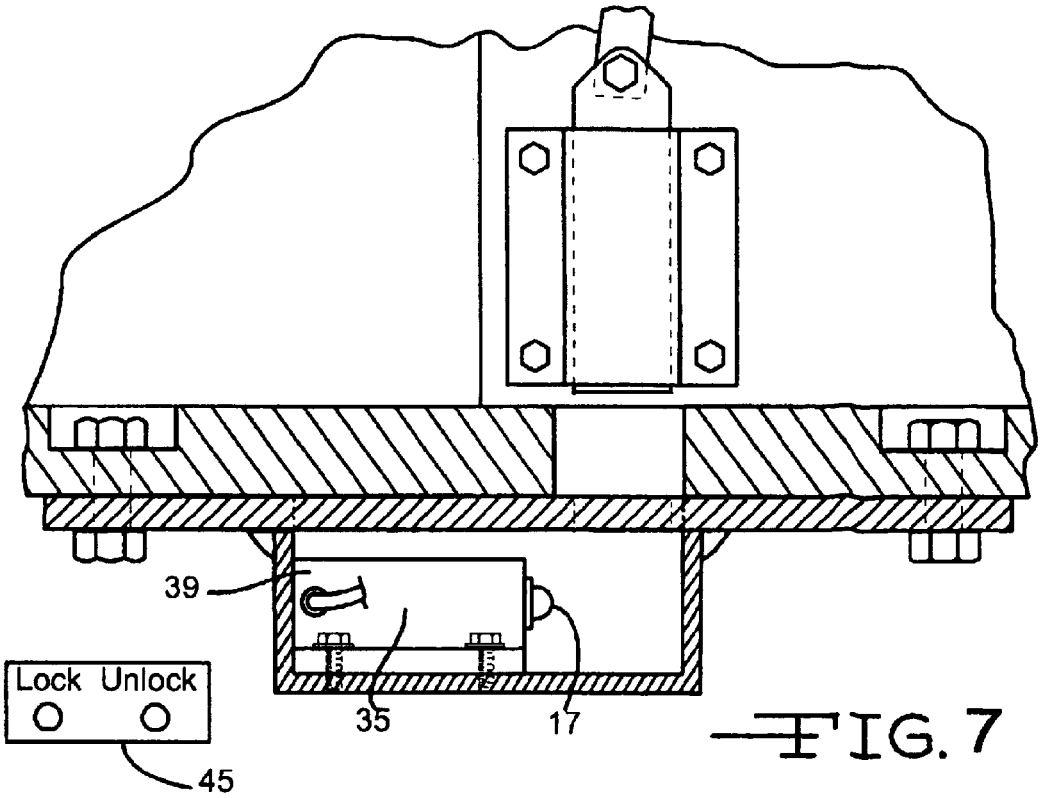
FIG. 7 is a cross sectional view of the locking mechanism of FIG. 6 in the unlocked position.

As shown in FIGS. 6 and 7, it is also possible to have a key pin 17 controlled by means of an electronic activator 35 that can be operated by a remote control system 45. One example of an electronic activator that can be used is a solenoid 39 that is attached to the key pin 17. The solenoid can be activated to move the key pin into and out of access opening 9 in the locking bar. The remote control device 45 can be used to activate the solenoid 39 to move the key pin 17 into and out of engagement with the pin access opening 9 on the locking bar 2 to lock or unlock the trailer door 14.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. A security system for a compartment defined in part by an upper wall, a lower wall, opposing sides and a door, said door, when closed, having an interior surface and an exterior surface comprising (a) a locking member slidably engaged to said interior surface and having a lower end movable upon movement of said locking member from a first position exteriorly of said lower wall to a second position interiorly of said lower wall;

(b) engagement means engaged by said lower end when in said first position preventing the opening of said door;

(c) retention means engageable with said lower end when said lower end is in said first position to prevent movement of said locking member and said lower end to said second position, said retention means includes a passageway in said lower end and a pin extending through said passageway; and a lock having a hasp which, when closed, cooperates with another portion of said lock to define an opening and wherein said pin includes an enlargement preventing movement thereof through said opening when said lock is closed.

2. A security system according to claim 1 wherein said retention means further includes an exterior housing extending downwardly below said lower wall and positioned to receive said lower end when in said first position, an aperture in said housing for receiving said pin, said aperture positioned to permit said pin introduced therein to extend through said passageway to a position at which said lock may be closed with said enlargement on the opposite side at said hasp from said lower end.

3. A security system for a compartment defined in part by an upper wall, a lower wall, opposing side and a door, said door, when closed, having an interior surface and an exterior surface comprising (a) a locking member slidably engaged to said interior surface and having a lower end movable upon movement of said locking member from a first position exteriorly of said lower wall to a second position interiorly of said lower wall;

(b) engagement means engaged by said lower end when in said first position preventing the opening of said door;

(c) retention means engageable with said lower end when said lower end is in said first position to prevent movement of said locking member and said lower end to said second position;

said retention means includes a passageway in said lower end and a pin extending through said passageway;

(d) a securing member slidably engaged to said interior surface and having an upper end movable from an upper position engageable with a stop member adjacent said upper wall to a lower position below said stop member; and (e) means interconnecting said locking member and said securing member such that movement of said interconnecting means in a first direction causes said locking member to move from said first position to said second position and said securing member to move from said upper position to said lower position and movement of said interconnecting means in a second direction causes said looking member to move from said second position to said first position and said securing member to move from said lower position to said upper position; and a locking having a hasp which, when closed, cooperates with another portion of said lock to define an opening and wherein said pin includes an enlargement preventing movement thereof through said opening when said lock is closed.

4. A security system according to claim 3 wherein said retention means further includes an exterior housing extending downwardly below said lower wall and positioned to receive said lower end when in said first position, an aperture in said housing for receiving said pin, said aperture positioned to permit said pin introduced therein to extend through said passageway to a position at which said lock may be closed with said enlargement on the opposite side of said hasp from said lower end.

* * * * *